US006854957B2

(12) United States Patent
Shi

(10) Patent No.: US 6,854,957 B2
(45) Date of Patent: Feb. 15, 2005

(54) SEAL OF A VERTICAL PUMP

(75) Inventor: Chi Wei Shi, Tao Yuan Hsien (TW)

(73) Assignee: Assoma, Inc., Tao Yuan Hsien (TW)

( * ) Notice: Subject to any disclaimer, the term of this patent is extended or adjusted under 35 U.S.C. 154(b) by 55 days.

(21) Appl. No.: 10/269,390

(22) Filed: Oct. 10, 2002

(65) Prior Publication Data

US 2004/0071551 A1 Apr. 15, 2004

(51) Int. Cl.[7] ..... F04D 29/08; F04D 29/12

(52) U.S. Cl. ..... 415/111; 415/174.5; 415/230; 417/423.11; 417/424.1; 277/347

(58) Field of Search ..... 415/111, 112, 415/174.5, 170.1, 174.2, 230, 231, 171.1; 277/346, 347, 353; 417/423.6, 923.11, 424.1

(56) References Cited

U.S. PATENT DOCUMENTS 2,459,036 A * 1/1949 Lipe et al. ..... 417/423.11
2,649,050 A * 8/1953 Dibdin ..... 415/174.5
4,152,092 A * 5/1979 Swearingen ..... 415/174.5
4,472,109 A * 9/1984 Blum ..... 415/174.5
4,917,572 A * 4/1990 Van Houten ..... 415/174.5

FOREIGN PATENT DOCUMENTS

GB 860456 A * 2/1961 ..... 415/231

* cited by examiner

*Primary Examiner*—Christopher Verdier
(74) *Attorney, Agent, or Firm*—Pro-Techtor Inter-National Services

(57) ABSTRACT

A seal of a vertical pump with a front casing disposed on a main casing which has a motor disposed therein. A volute chamber is disposed inside the front casing to receive a centrifugal impeller. A suction inlet is disposed axially on the front casing opposite the motor. A water outlet is disposed thereon opposite the lateral side of the impeller to engage with a discharge pipe. The suction inlet and outlet are in communication with a volute chamber. The pump has a non-contact seal disposed on the impeller. The seal can jam when a liquid crystallizes. Therefore, if no heat is generated due to the friction of the seal, the pump operates better. Furthermore, it prevents a back impeller vane from stirring the air and ejecting the liquid with a lot of air bubbles when the pump operates. Therefore, it eliminates the air bubbles from causing problems during the manufacturing process of a printed circuit board.

2 Claims, 4 Drawing Sheets

SEAL OF A VERTICAL PUMP

BACKGROUND OF THE INVENTION

1) Field of the Invention

The present invention relates to a seal of a vertical pump, and more particularly to a structure having a non-contact and improved labyrinth seal disposed on the impeller.

2) Description of the Prior Art

As indicated in FIGS. 1 and 2, a traditional pump is used at a chemical engineering site for pumping and delivering strong acid, alkali, and corrosive liquid. A cantilever shaft (200) disposed at the front end of a motor (100); a V-type oil seal (300) or a lip seal is disposed near the tail end of the cantilever shaft (200). The main purpose of the seal device is to block the acid and alkali liquid because the V-type oil seal (300) becomes ineffective once it contacts the liquid, especially liquid that crystallizes. That would further corrode an axle center of the motor (100). The front end of the cantilever shaft (200) vertically connects with an axle center of an impeller (400); the backside of the impeller (400) is disposed with a back vane (401). In addition, a front casing (500) is inserted on a main casing; a suction inlet (501) is disposed axially on the front casing (500) opposite the motor (100); a water outlet (502) is disposed on opposite the impeller (400) to engage a discharge pipe (600). The suction inlet (501) and the water outlet (502) are in communication with a volute chamber (700). In an actual implementation, a liquid flows axially from the axial suction inlet (501) toward the impeller (400) which rotates to operate; the volute chamber (700) gathers high pressure liquid and conducts it through the water outlet (502). However, the conventional vertical pump has two shortcomings:

1. It uses the back vane (401) to eliminate the back pressure of the impeller (400). However, the back vane (401) stirs the air and the delivery liquid to create a lot of air bubbles; the air bubbles tremendously increase the defect rate during the manufacturing process of a printed circuit board.

2. When the pump stops and the back vane (401) is not working, the liquid flows toward the V-type seal (300) above the liquid surface in a similar water hammer effect. If the liquid left on the seal device crystallizes, it damages the V-type seal (300) device or the lip seal. Although some manufacturers suggested the use of a check valve to solve this problem, most of the machines do not have enough space for installation, and the crystallization might make the check valve inefficient.

SUMMARY OF THE INVENTION

Therefore, the primary objective of the present invention is to dispose a non-contact seal on the impeller of a vertical pump to prevent a back vane from stirring the air and causing the pump to eject a liquid with a lot of bubbles so as to eliminate the air bubbles from causing any serious undesired effect during the manufacturing process of a printed circuit board.

Another objective of the present invention is to dispose the non-contact seal as a non-contact labyrinth seal so as to prevent the liquid crystallization which might jam the seal, and to eliminate the heat generation due to the friction of the seal.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
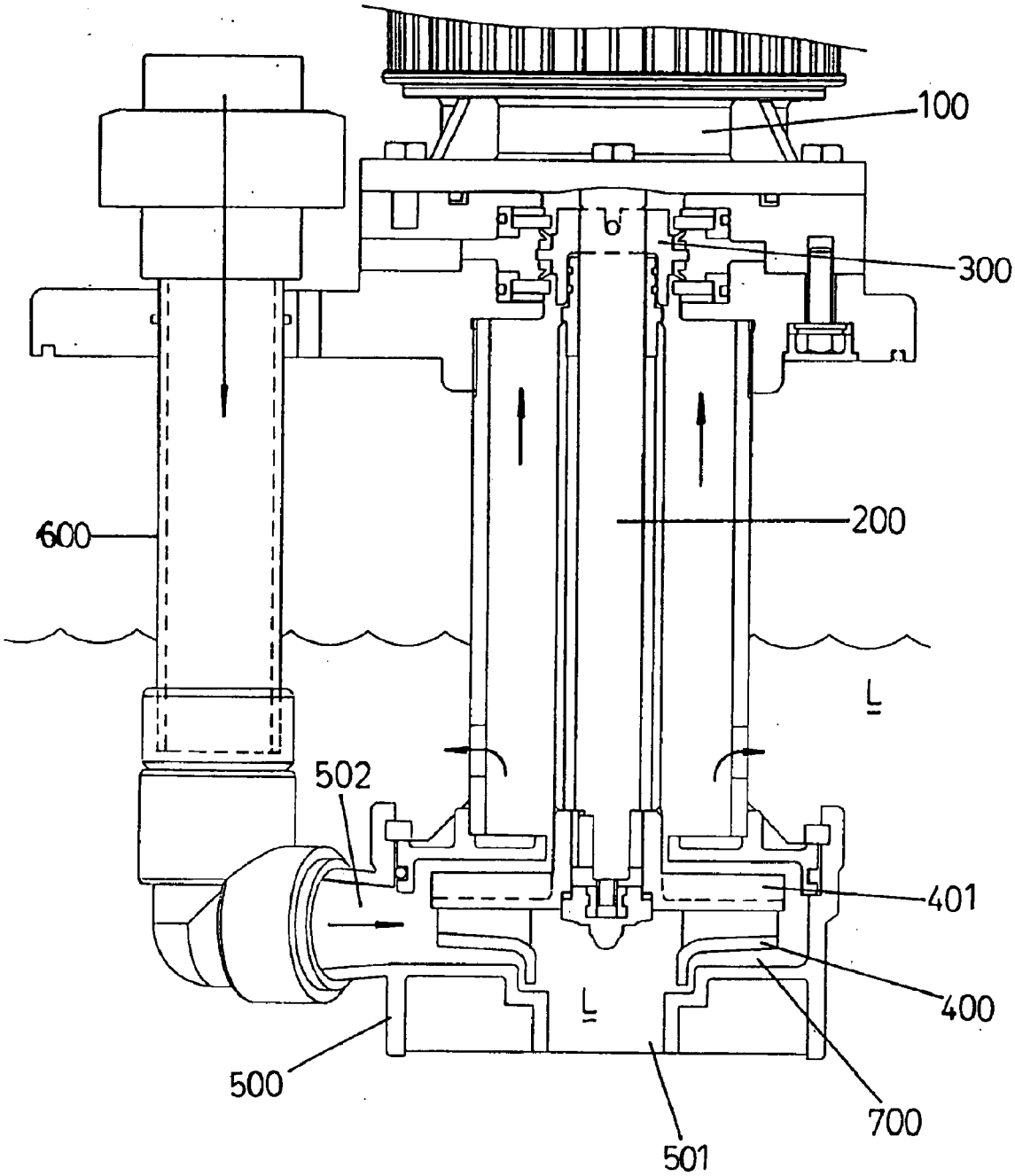
FIG.1 (PRIOR ART)
FIG. 1 is a cross-sectional drawing of a conventional product.
Figure 2:
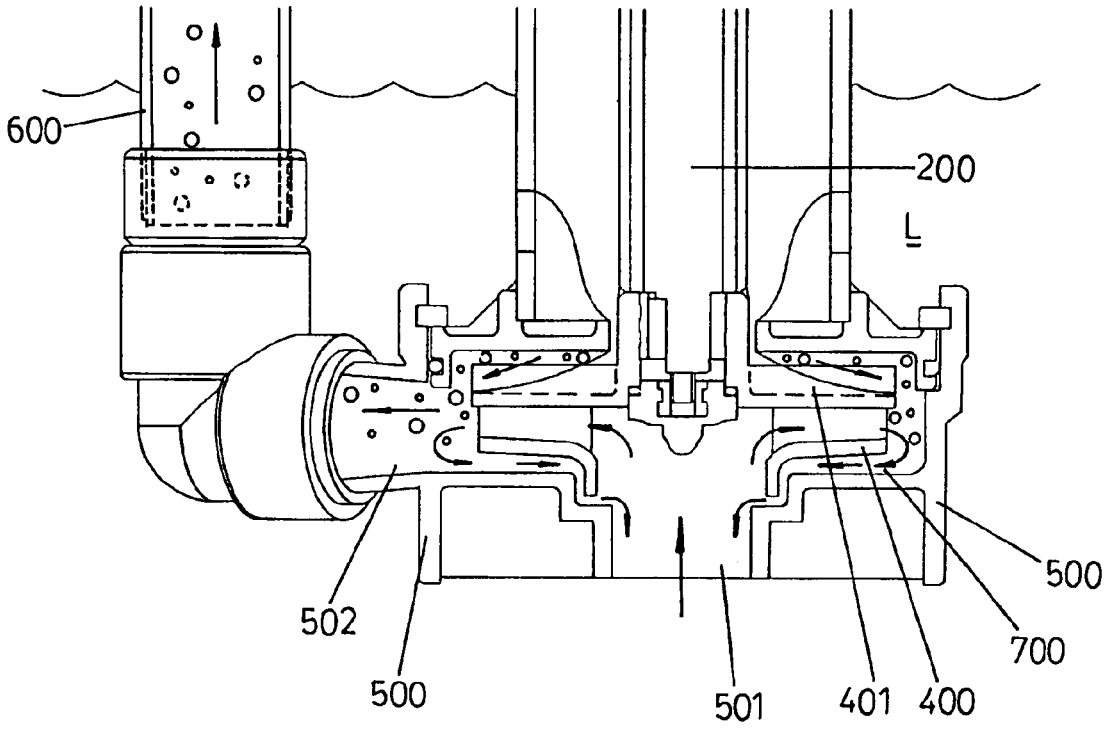
FIG.2 (PRIOR ART)
FIG. 2 is a cross-sectional drawing of a part of the conventional product.
Figure 3:
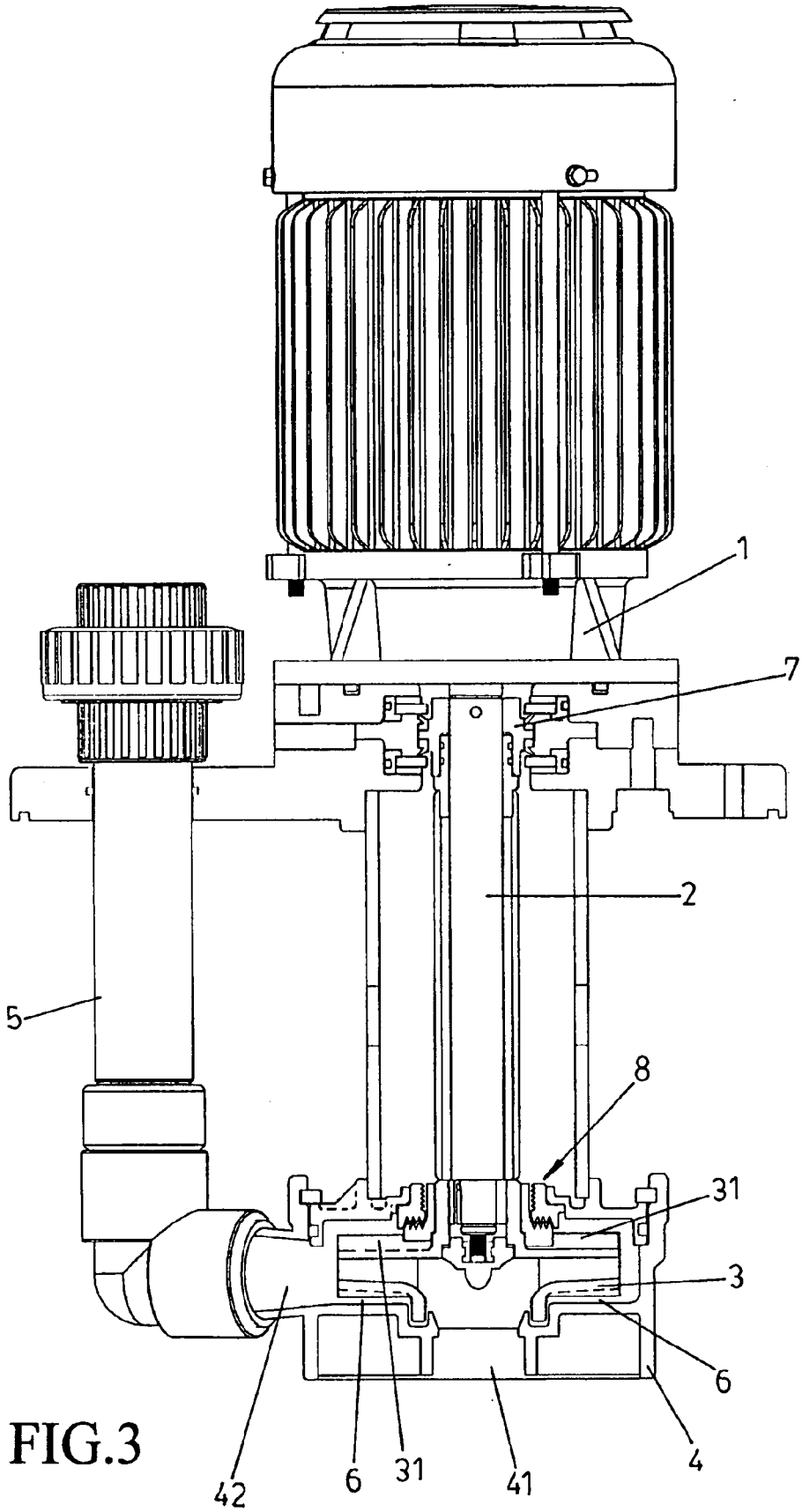
FIG. 3 is a cross-sectional drawing of the present invention.
Figure 4:
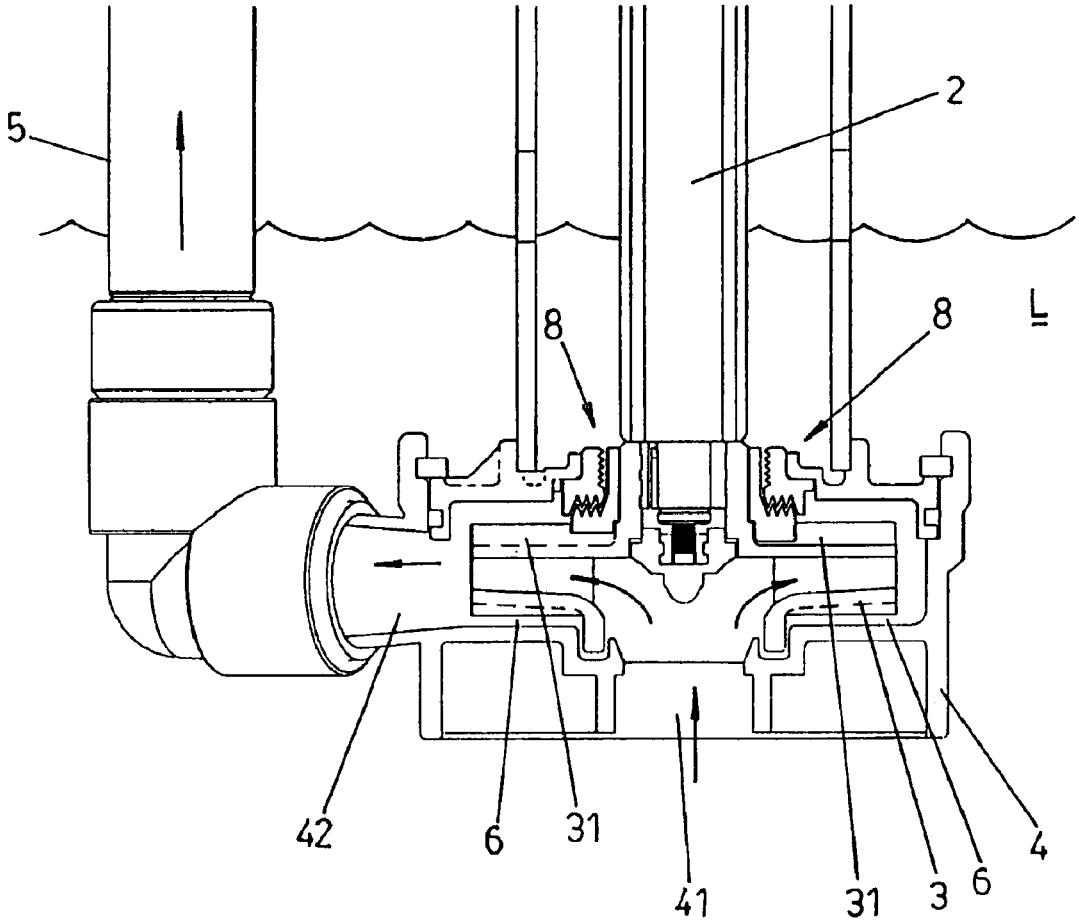
FIG. 4 is a cross-sectional drawing of a part of the present invention.

As indicated in FIGS. 3 and 4, the present invention of a vertical pump comprises a front casing (4) disposed on a main casing which has a motor (1) disposed therein; a cantilever shaft (2) of the motor (1) is located toward the front casing (1); a volute chamber (6) is disposed inside the front casing (4) for placing a centrifugal impeller (3); a suction inlet (41) is disposed axially on the front casing (4) opposite the motor (1); a water outlet (42) is disposed on the casing opposite the lateral side of the impeller (3) to engage with a discharge pipe (5); both the suction inlet (41) and the water outlet (42) are in communication with the volute chamber (6). The V-type oil seal (7) device is axially mounted on the cantilever shaft (2) near the motor (1).

The present invention is mainly characterized by a non-contact seal (8) that is disposed on the impeller (3). The functions of the non-contact seal (8) of the present invention are as follows:

1. It prevents a back impeller vane from stirring the air and ejecting the liquid with a lot of air bubbles when the pump operates. Therefore, it eliminates the air bubbles from causing serious defects during the manufacturing process of a printed circuit board.

2. It prevents the acid and alkali liquid from flowing to the V-type oil seal (7) device located above the liquid surface when the pump stops and the pressure fails to be discharged in time.

3. The non-contact seal (8) is a non-contact labyrinth seal. Therefore, it prevents the possibility of having the seal (8) being stuck or jammed due to liquid crystallization, and reduces the possibility of heat generation due to the friction of the seal.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A seal of a vertical pump comprising:

a front casing disposed fixedly and forwardly on a main casing which has a motor disposed therein;

a cantilever shaft of the motor is located toward the front casing;

a volute chamber is disposed inside the front casing to receive a centrifugal impeller;

a suction inlet is disposed axially and forwardly on the front casing opposite the motor;

a water outlet is disposed upwardly on the front casing and opposite the lateral side of the impeller to engage a discharge pipe; both the suction inlet and the water outlet are in communication with the volute chamber; and a non-contact seal is disposed at the rear of the impeller that prevents acid and alkali liquid from flowing reversely toward a v-type oil seal located above a liquid surface when the pump stops and the pump pressure fails to be discharged in time.

2. The seal of a vertical pump according to claim 1, wherein the non-contact seal is a labyrinth seal.

* * * * *